US008093838B2

(12) United States Patent
Wang et al.

(10) Patent No.: US 8,093,838 B2
(45) Date of Patent: Jan. 10, 2012

(54) DRIVING CIRCUIT AND METHOD FOR PREVENTING LAMP FROM BLASTING

(75) Inventors: Chih-Lin Wang, Hsin-Chu (TW); Po-Yen Wu, Hsin-Chu (TW)

(73) Assignee: Coretronic Corporation, Hsin-Chu (TW)

( * ) Notice: Subject to any disclaimer, the term of this patent is extended or adjusted under 35 U.S.C. 154(b) by 598 days.

(21) Appl. No.: 12/257,145

(22) Filed: Oct. 23, 2008

(65) Prior Publication Data

US 2009/0167212 A1 Jul. 2, 2009

(30) Foreign Application Priority Data

Dec. 31, 2007 (TW) ..... 96151580 A

(51) Int. Cl.
*G05F 1/00* (2006.01)

(52) U.S. Cl. ..... 315/308; 315/247; 315/291; 315/224

(58) Field of Classification Search ..... 315/246, 315/247, 291, 294, 297, 307–308
See application file for complete search history.

(56) References Cited

U.S. PATENT DOCUMENTS

| | | | | |
|---|---|---|---|---|
| 2006/0006818 | A1* | 1/2006 | Fishbein et al. | 315/291 |
| 2007/0108919 | A1* | 5/2007 | Tsai et al. | 315/291 |
| 2008/0012510 | A1* | 1/2008 | Po | 315/308 |
| 2009/0122003 | A1* | 5/2009 | Chen et al. | 345/102 |
| 2009/0315469 | A1* | 12/2009 | Chung | 315/219 |

* cited by examiner

*Primary Examiner* — Shawki S Ismail
*Assistant Examiner* — Jany Tran
(74) *Attorney, Agent, or Firm* — Chun-Ming Shih

(57) ABSTRACT

In a driving circuit and method for preventing a lamp from blasting, a driving circuit includes a control circuit module, a voltage conversion circuit module, a driving module and a feedback circuit. The control circuit module outputs a first control signal according to a predetermined setting. The voltage conversion circuit module receives the first control signal and converts the first control signal into a second control signal. The driving module receives the second control signal and generates a driving signal according to the second control signal for driving the lamp. The feedback circuit electrically couples to one of the control circuit module, the voltage conversion circuit module and the driving module for receiving a feedback signal therefrom. The feedback signal is transmitted to the control circuit module, so that the control circuit module may adjust the first control signal according to the feedback signal.

14 Claims, 6 Drawing Sheets

DRIVING CIRCUIT AND METHOD FOR PREVENTING LAMP FROM BLASTING

BACKGROUND

The invention is related to a lamp driving circuit, especially to a driving circuit and a method for preventing lamps from blasting.

As shown in FIG. 1, a conventional lamp used in a specific device such as a projector, because of the requirements on light emitting specified by the device, a lamp driving circuit 100 capable of providing a complicated driving signal is usually used to drive the lamp. In the lamp driving circuit 100, a control signal sync control input (SCI) is generated by an application specified integrated circuit (ASIC) 110. The control signal SCI is converted into a voltage level suitable for a driving module 130 to use via a voltage conversion circuit 120 and the voltage level is outputted to the driving module 130. The driving module 130 generates a driving signal for driving and controlling the lamp 140 to be turned on/off and adjusting the brightness of the lamp 140 according to a signal being received from the driving module 130.

For such the lamp, the changes of the brightness status are usually in accordance with a wave shape of a standard driving signal. However, because the lamp may be rather delicate, if the driving signal has a great deviation in wave shape with respect to that of the standard driving signal, the lamp may blast. So far, there is no solution to prevent the lamp from blasting although it is known that the deviation may lead the lamp to blast.

BRIEF SUMMARY

The present invention is to provide a driving circuit for preventing a lamp from blasting caused by errors of a driving signal.

The present invention is to provide a method for preventing a lamp from blasting. The method includes detecting whether a control signal or a driving signal is essentially inconsistent with a standard control signal or a standard driving signal and stopping driving the lamps for preventing the lamp from blasting when the detected signal is essentially inconsistent with the standard signal.

According to an embodiment of the present invention, a driving circuit is provided for driving a lamp and capable of preventing the lamp from blasting. The driving circuit includes a control circuit module, a voltage conversion circuit module, a driving module and a feedback circuit. The control circuit module stores with a predetermined setting and includes an input terminal and an output terminal. The control circuit module outputs a first control signal being generated from the output terminal according to the predetermined setting. The voltage conversion circuit module receives the first control signal and convert the first control signal into a second control signal. The driving module receives the second control signal and generates a driving signal according to the second control signal for driving the lamp. One end of the feedback circuit electrically couples to the input terminal of the control circuit module and the another end of the feedback circuit electrically couples to at least one of the output terminal of the control circuit module, the voltage conversion circuit module and the driving module for receiving a feedback signal therefrom and transmitting the feedback signal to the control circuit module, wherein the control circuit module adjusts the first control signal according to the feedback signal being received from the feedback circuit.

According to an embodiment of the present invention, the driving circuit further includes a reduction voltage conversion circuit module. The reduction voltage conversion circuit module electrically couples between the voltage conversion circuit module and the another end of the feedback circuit, or couples between the driving module and the another end of the feedback circuit. A voltage level of the signal outputted from the voltage conversion circuit module or the driving module is converted by the reduction voltage conversion circuit module to a suitable voltage level adapted for the control circuit module. A method for preventing a lamp from blasting is provided in an embodiment of the present invention. The method generates a control signal according to a predetermined setting and generates a corresponding driving signal according to the control signal for driving the lamp. The method provides a standard control signal or a standard driving signal and stops driving the lamp when the control signal is essentially inconsistent with the standard control signal or the driving signal is essentially inconsistent with the standard driving signal.

According to an embodiment of the invention, the duty cycle of the control signal is compared to that of the standard control signal so as to determine whether the control signal is essentially consistent with the standard control signal. Similarly, the duty cycle of the driving signal is compared to that of the standard driving signal so as to determine whether the driving signal is essentially consistent with the standard driving signal.

The control signal or the driving signal is detected and converted into the feedback signal and transmitted to the control circuit module, a comparison between the feedback signal and the standard control signal or the standard driving signal is made, and then according to the comparison, whether to drive the lamp with the driving signal is determined so as to effectively prevent a lamp from blasting for receiving an inappropriate driving signal due to either human error in inputting the predetermined setting or aging problems of the circuit.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
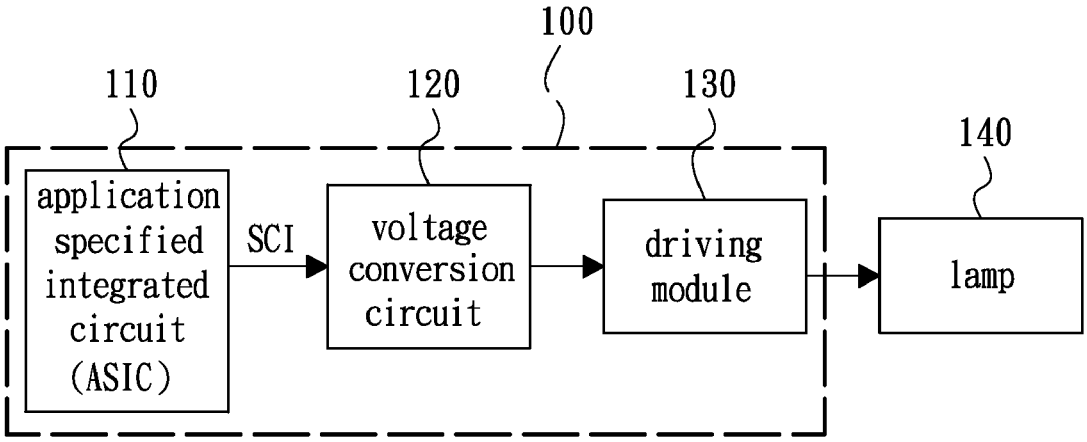
FIG. 1(Related Art)
FIG. 1 is a block diagram of a conventional lamp driving circuit.
Figure 2:
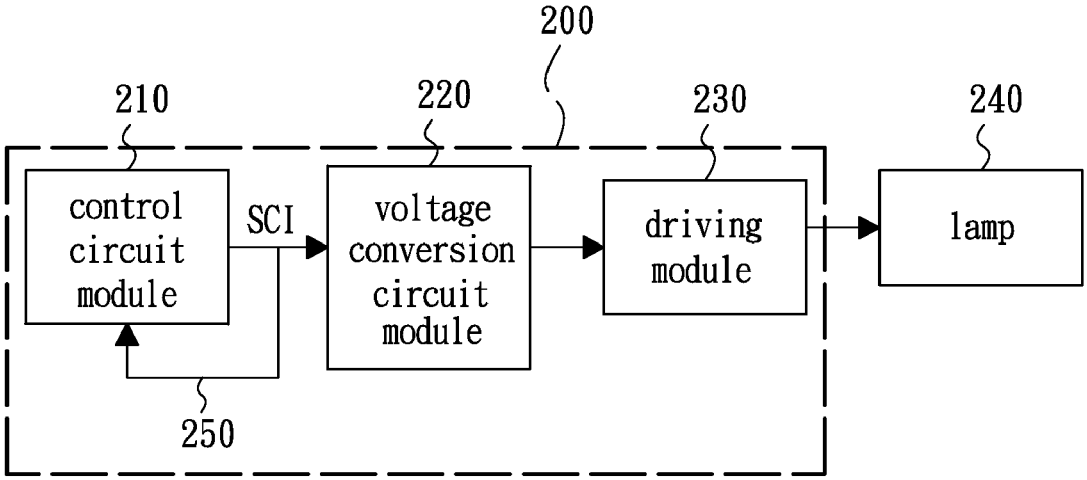
FIG. 2 shows a block diagram of a driving circuit capable of preventing a lamp from blasting according to an embodiment of the invention.

Referring to FIG. 2, a block diagram of a driving circuit capable of preventing a lamp from blasting according to an embodiment of the invention is provided. In this embodiment, the driving circuit 200 for driving a lamp 240 and capable of preventing the lamp 240 from blasting includes a control circuit module 210, a voltage conversion circuit module 220, a driving module 230, and a feedback circuit 250. The manufacturer may store a predetermined setting in the control circuit module 210 during design, and when the control circuit module 210 runs according to the predetermined setting, a corresponding Sync Control Input (SCI) signal (indicated as "first control signal") is provided by an output terminal of the control circuit module 210 to be an output signal of the control circuit module 210. The voltage conversion circuit module 220 receives the first control signal and converts the first control signal into a second control signal, and a voltage level of the second control signal is suitable to be adapted for the driving module 230. The second control signal is transmitted to the driving module 230, and the driving module 230 generates a corresponding driving signal according to the second control signal for driving the lamp 240.

Figure 6:
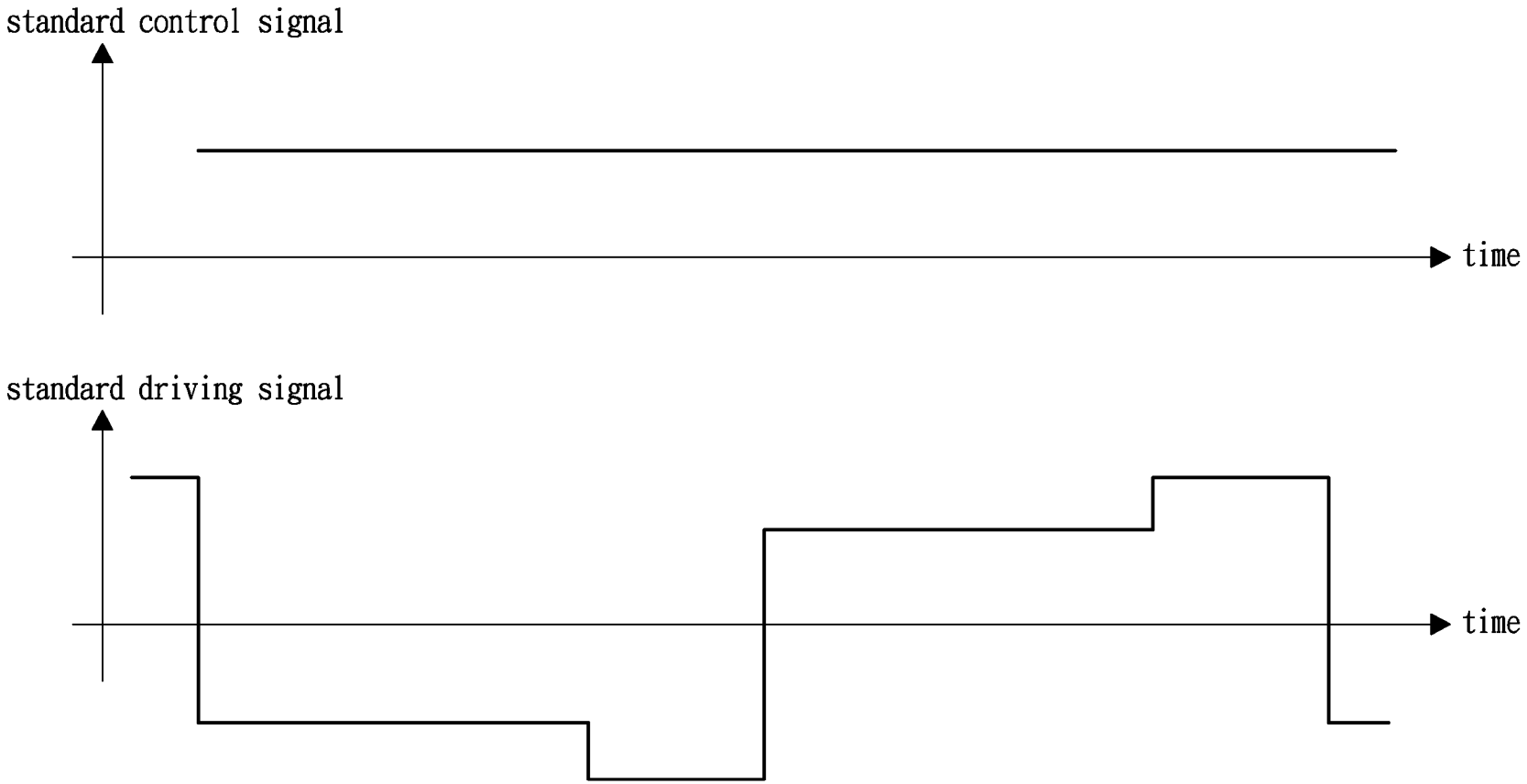
FIG. 6 shows a relationship drawing of a standard control signal and a corresponding standard driving signal.
Figure 7:
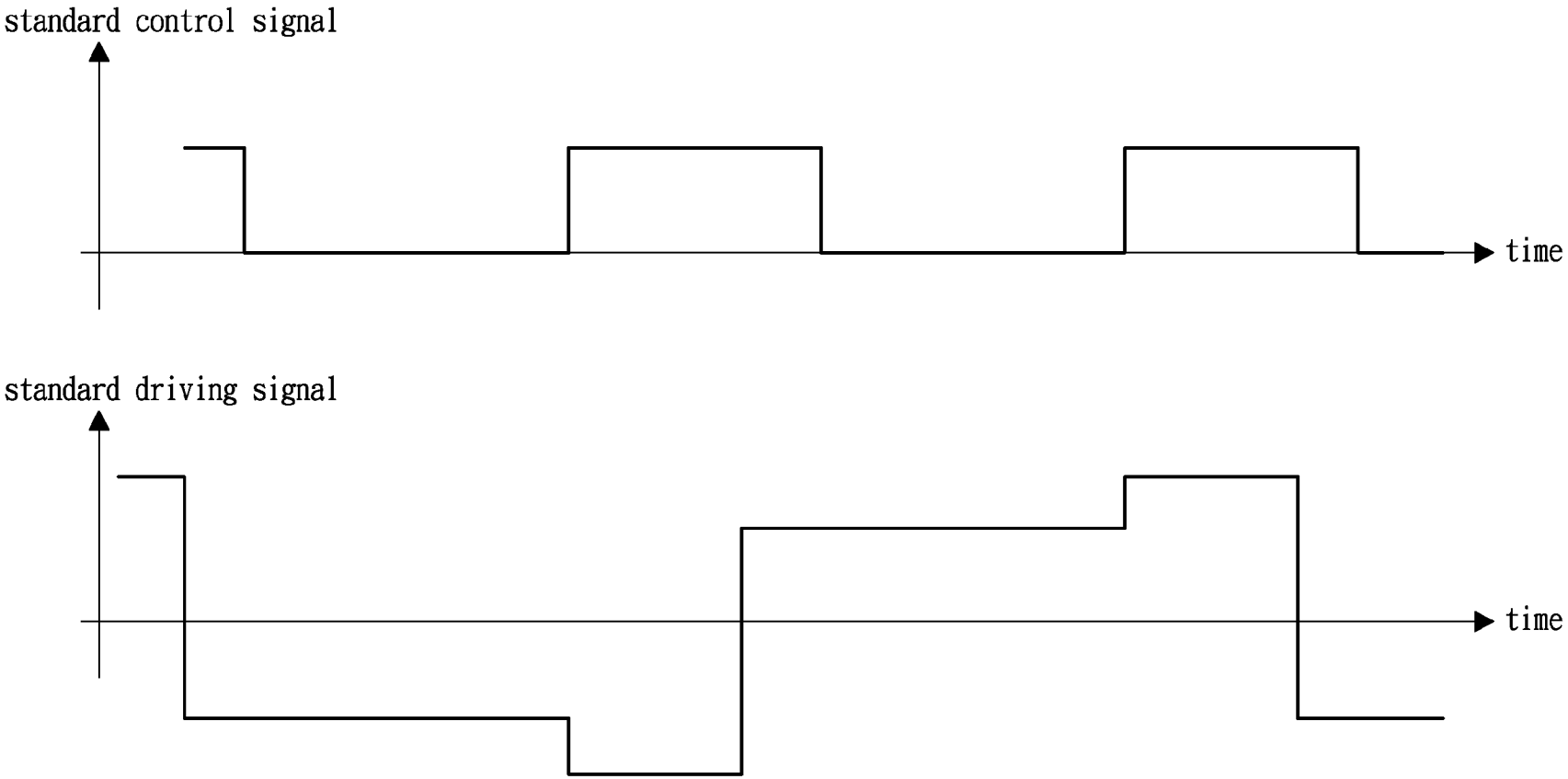
FIG. 7 shows another relationship drawing of a standard control signal and a corresponding standard driving signal.

According to this embodiment of the invention, the related information of the standard control signal is stored in the control circuit module 210 in advance, such as amplitude of vibration or wave shape. The standard control signal is a normal control signal on the assumption that the above predetermined setting is right and the control circuit module runs normally completely, as shown in FIG. 6 or FIG. 7. Also referring to FIG. 6 and FIG. 7, relationships between different standard control signals and the standard driving signals respectively derived therefrom are shown. Similarly, the standard driving signal is a normal driving signal on the assumption that the above predetermined setting is right, and the control circuit module, the voltage conversion circuit module and the driving module run normally completely. Moreover, it is to be noticed, in this embodiment that the driving signals are to be assumed for driving the same type of lamps so that their corresponding standard driving signals may have the same mode (assuming the lamps are driven in the same mode), however, according to the design variances of the control circuit module 210 and the driving circuit module 230, the standard control signal outputted from the control circuit module 210 may be different.

As shown in FIG. 2, one end of the feedback circuit 250 is electrically coupled to an input terminal of the control circuit module 210. Another end of the feedback circuit 250 is electrically coupled to the output terminal of the control circuit module 210. So that the feedback circuit 250 may feedback the first control signal outputted from the control circuit module 210 to the above described input terminal of the control circuit module 210. The control circuit module 210 may compare the first control signal with the pre-stored standard control signals. If the first control signal is essentially consistent with any standard control signal, the control circuit module 210 may generate the first control signal continuously. On the contrary, if the first control signal is essentially inconsistent with the standard control signal, then the control circuit module 210 may stop outputting the first control signal to prevent the lamp 240 from driving with inappropriate driving signal and blasting.

When the described control circuit module 210 compares the first control signal with the standard control signal, the comparison may be made upon parameters such as duty cycle time, wave shape or amplitude. If the result of the comparison is "same", it is considered that the first control signal is essentially consistent with the standard control signal. On the contrary, if the result of the comparison is "different", it is considered that the first control signal is essentially inconsistent with the standard control signal.

Figure 3A:
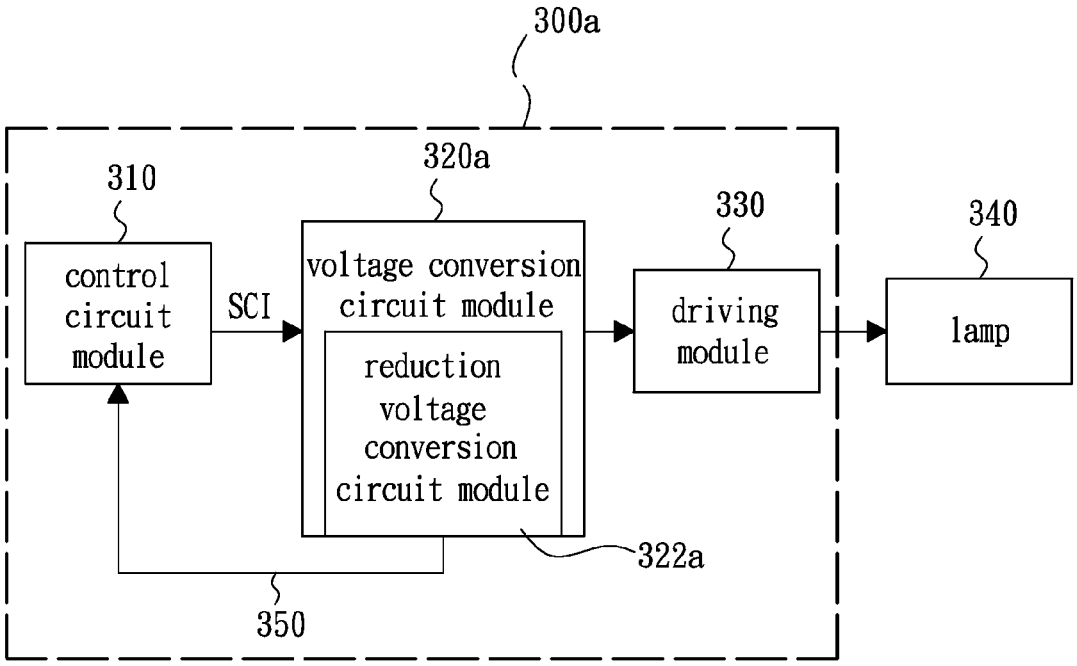
FIG. 3A shows a block diagram of a driving circuit capable of preventing a lamp from blasting according to another embodiment of the invention.

Referring to FIG. 3A, it shows a block diagram of a driving circuit capable of preventing a lamp from blasting according to another embodiment of the invention. According to this embodiment, the driving circuit 300 capable of preventing a lamp from blasting is different to the one according to the embodiment in FIG. 2. The difference is in that another end of the feedback circuit 350 is electrically coupled to the voltage conversion circuit module 320*a*, instead of being electrically coupled to the output terminal of the control circuit module 310. Accurately speaking, the feedback circuit 350 is electrically coupled to an output terminal of an reduction voltage conversion circuit module 322*a*. That is, the reduction voltage conversion circuit module 322*a* is electrically coupled between the feedback circuit 350 and the voltage conversion circuit module 320*a*, and the reduction voltage conversion circuit module 322*a* reduces the voltage level converted from the first signal by the voltage conversion circuit module 320*a* to a suitable voltage level to be adapted for the control circuit module 310.

Similarly, in theory, if the first control signal or the circuit device runs normally, the second control signal achieved by the voltage conversion circuit module 320*a* is a result of amplification, reduction or amplitude shift of the first control signal. After the operation of the reduction voltage conversion circuit module 322*a*, the feedback signal sent to the control circuit module 310 by the feedback circuit 350 is essentially consistent with the standard control signal stored in the control circuit module 310. But if the feedback signal is essentially inconsistent with the standard control signal, the control circuit module 310 stops outputting signals and shuts down the driving module 330 to prevent the lamp 340 from blasting.

Figure 3B:
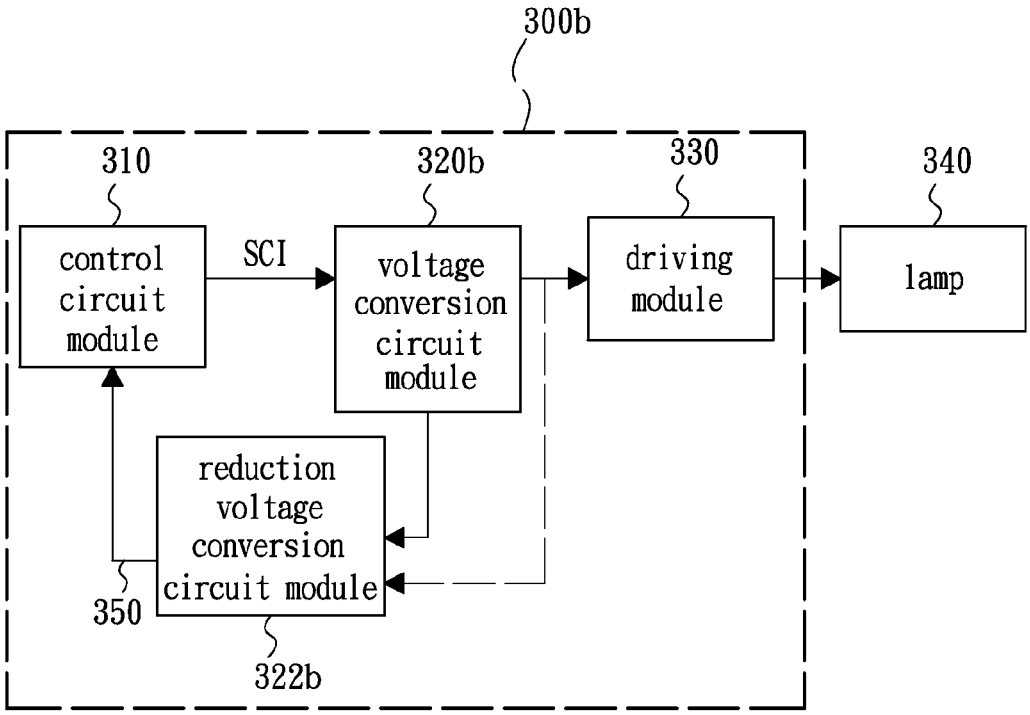
FIG. 3B shows a block diagram of a driving circuit capable of preventing a lamp from blasting according to another embodiment of the invention.

Referring to FIG. 3B, it shows a block diagram of a driving circuit for preventing a lamp from blasting according an embodiment of the invention. According to this embodiment, the difference between the driving circuit and the one of FIG. 3A is that the reduction voltage conversion circuit module 322*b* is not disposed in the voltage conversion circuit module 320*b*. So not only may the converted first control signal be achieved by the voltage conversion circuit module 320*b*, the voltage conversion circuit module 320*b*, but also the reduction voltage conversion circuit module 322*b* may receive a second control signal by being electrically coupled to an output terminal of the voltage conversion circuit module 320*b*. The operation and comparison are similar to those according to the embodiments described.

Figure 3C:
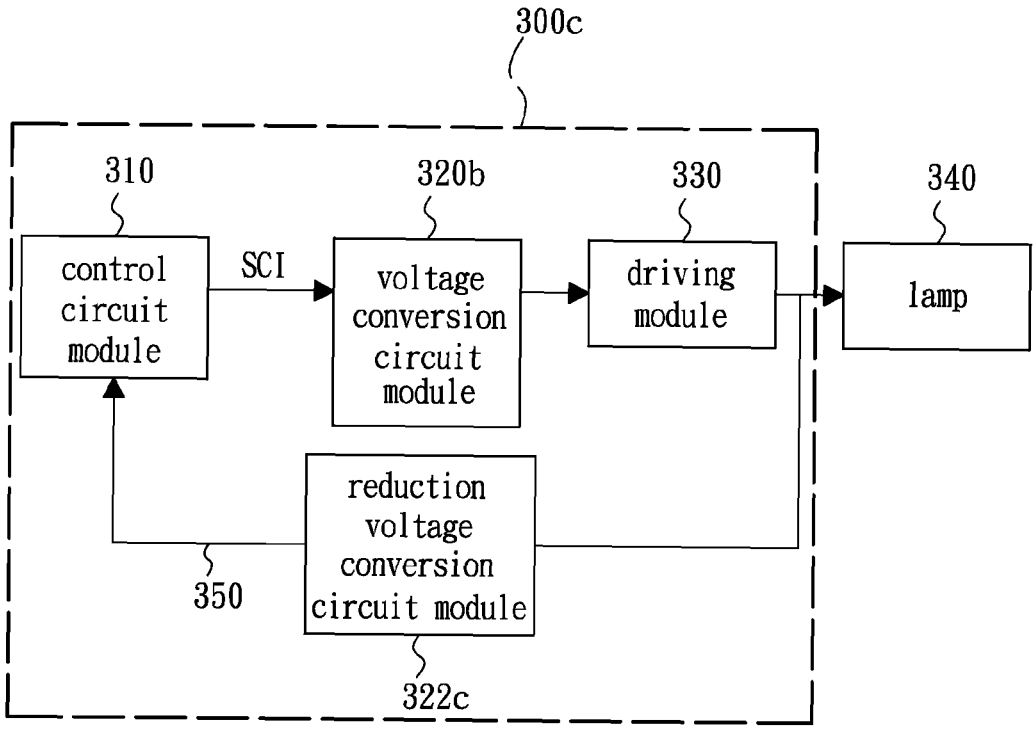
FIG. 3C shows a block diagram of a driving circuit capable of preventing a lamp from blasting according to another embodiment of the invention.

Referring to FIG. 3C, it shows a block diagram of a driving circuit for preventing a lamp from blasting according to an embodiment of the invention. According to this embodiment, the difference between the driving circuit and the ones of FIG. 3A and FIG. 3B is that the reduction voltage conversion circuit module 322*c* is electrically coupled to the driving module 330 and the feedback circuit 350. Therefore, the reduction voltage conversion circuit module 322*c* is used to convert the voltage level of the driving signal generated by the driving module 330 to a suitable voltage level to be adapted for the control circuit module 310, and the feedback circuit 350 transmits the converted feedback signal to the control circuit module 310. Different from the described ones, the feedback signal is converted from the driving signal and compared to the standard driving signal stored in the control circuit module 310. Similarly, if the feedback signal is essentially inconsistent with the standard control signal, the control circuit module 310 stops outputting signals and shuts down the driving module 330 to prevent the lamp 340 from blasting.

Figure 4:
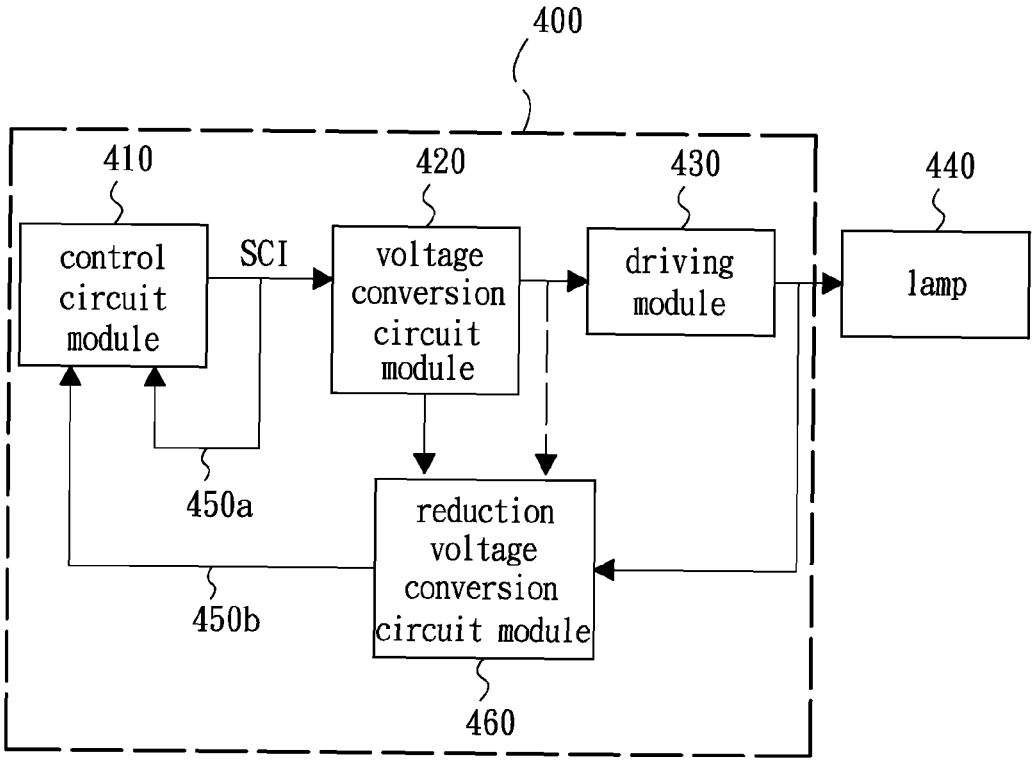
FIG. 4 shows a block diagram of a driving circuit capable of preventing a lamp from blasting according to another embodiment of the invention.

Referring to FIG. 4, it shows a block diagram of a driving circuit for preventing a lamp from blasting according to an embodiment of the invention. The driving circuit according to the present embodiment is a combination of those of FIG. 2 and FIGS. 3A-3C. The first control signal may be transmitted to the control circuit module 410 by the feedback circuit 450*a*. Moreover, the second control signal generated by the voltage conversion circuit module 420 and the driving signal generated by the driving module 430 may be transmitted to the control circuit module 410 by the feedback circuit 450*a* after a voltage level converted correspondingly by the reduction voltage conversion circuit module 460. Similarly, if it is judged from a comparison by the control circuit module 410 that the feedback signal generated from the control signal is essentially inconsistent with the standard control signal, or the feedback signal generated from the driving signal is essentially inconsistent with the standard driving signal, the control circuit module 410 and the driving module 430 may shut down to prevent the lamp 440 from blasting.

Figure 5:
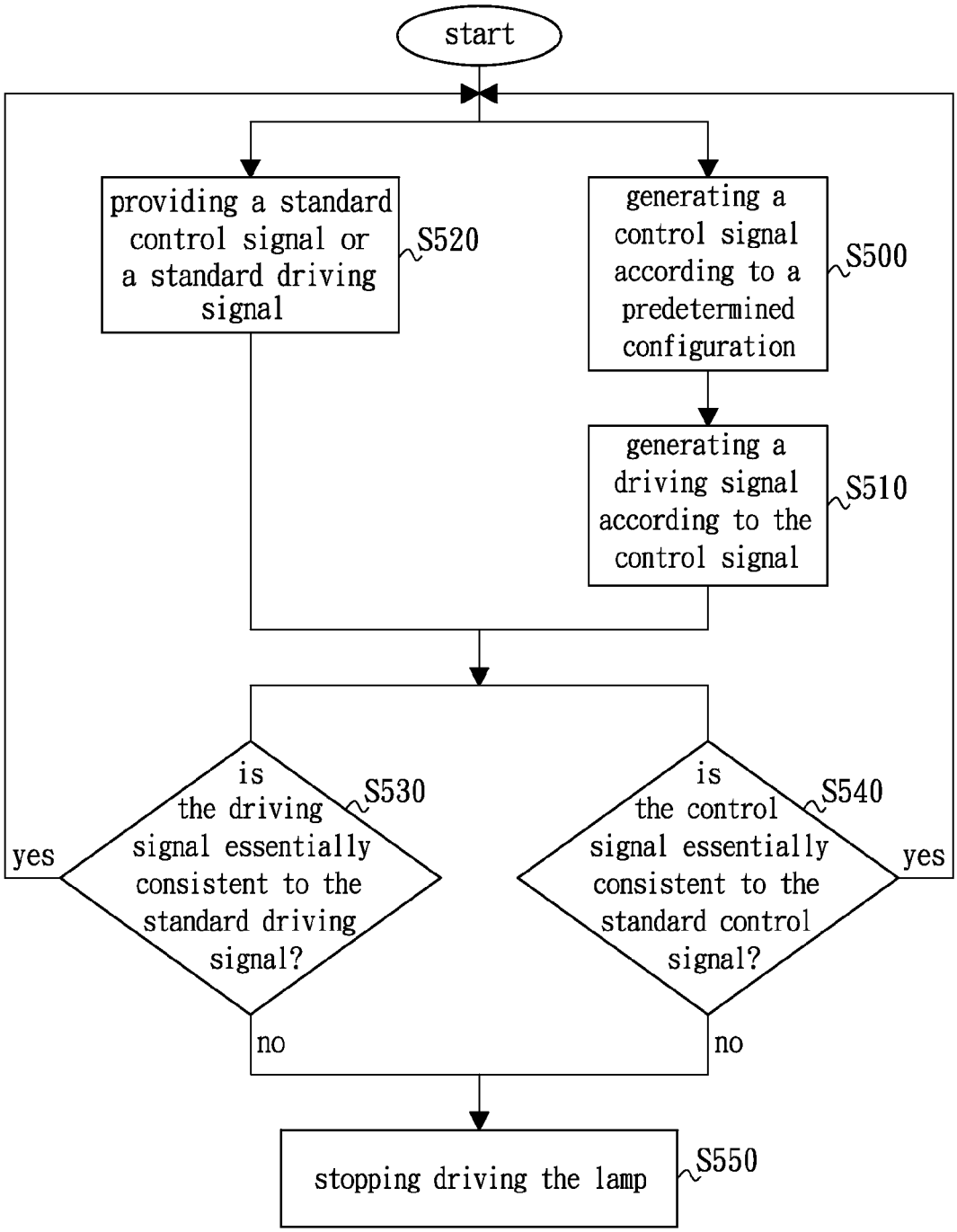
FIG. 5 shows a flow chart of a method for preventing a lamp from blasting according to an embodiment of the invention.

On the other hand, a method for preventing a lamp from blasting is provided for an embodiment of the invention. Referring to FIG. 5, it shows a flow chart of a method for preventing a lamp from blasting according to an embodiment of the invention. According to this embodiment, the method includes the following steps: generating a corresponding control signal according to a predetermined setting at a start of driving a lamp (step S500); generating a corresponding driving signal according to the control signal to drive the lamp (step S510); providing a standard control signal or a standard driving signal to be in a suitable position, such as a memory, for comparing with the above-mentioned control signal or the driving signal (step S520); comparing the control signal to the standard control signal (step S540) and stopping driving the lamp if the comparison of S540 shows the control signal is not essentially consistent with the standard control signal (step S550); or comparing the driving signal to the standard driving signal (step S530) and stopping driving the lamp if the comparison of S530 shows the driving signal is not essentially consistent with the standard driving signal (step S550).

As we known, the step S540 does not need to be run after the step S510. In fact, a comparison of the control signal and the standard control signal may be carried out after generating a control signal according to a predetermined setting in the step S500.

It has been found that there are a lot of factors that may lead to a wave shape inconsistency between the driving signal and the standard driving signal, such as human error in inputting a predetermined setting for generating a control signal or aging of the circuits that leads to a functional error. The above-mentioned control signal or the driving signal generated by detecting is converted into a feedback signal and transmitted to the control circuit module, a comparison between the feedback signal and the standard control signal or the standard driving signal is made, and then according to the comparison whether to drive the lamp with the driving signal is determined so as to effectively prevent a lamp from blasting for receiving an inappropriate driving signal due to either human error in inputting the predetermined setting or aging problems of the circuit.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A driving circuit for driving a lamp and capable of preventing the lamp from blasting, comprising:

a control circuit module, storing a predetermined setting and comprising an input terminal and an output terminal, a first control signal being generated from the output terminal in accordance with the predetermined setting;

a voltage conversion circuit module, electrically coupled to the output terminal of the control circuit module, to receive the first control signal and convert the first control signal into a second control signal;

a driving module, electrically coupled to the voltage conversion circuit module, to receive the second control signal and generate a driving signal in accordance with the second control signal to drive the lamp; and a feedback circuit, one end thereof electrically coupled to the input terminal of the control circuit module and another end electrically coupled to at least one of the output terminal of the control circuit module, the voltage conversion circuit module and the driving module, for receiving a feedback signal therefrom, and transmitting the feedback signal to the control circuit module, wherein the control circuit module adjusts the first control signal according to the feedback signal being received from the feedback circuit;

wherein a standard control signal is stored in the control circuit module, and the control circuit module compares a duty cycle of the standard control signal with that of the feedback signal to determine whether the feedback signal is essentially consistent with the standard control signal.

2. The driving circuit according to claim 1, wherein the another end of the feedback circuit electrically coupled to the output terminal of the control circuit module.

3. The driving circuit according to claim 2, wherein if the feedback signal is essentially inconsistent with the standard control signal, the control circuit module stops outputting the first control signal.

4. The driving circuit according to claim 1, wherein the another end of the feedback circuit is electrically coupled to the voltage conversion circuit module.

5. The driving circuit according to claim 4, further comprising a reduction voltage conversion circuit module electrically coupled between the voltage conversion circuit module and the another end of the feedback circuit, wherein the reduction voltage conversion circuit module converts a voltage level of the signal outputted from the voltage conversion circuit module to a suitable voltage level to be adapted for the control circuit module.

6. The driving circuit according to claim 4, wherein if the feedback signal is essentially inconsistent with the standard control signal, the control circuit module stops outputting the first control signal.

7. A driving circuit for driving a lamp and capable of preventing the lamp from blasting, comprising:

a control circuit module, storing a predetermined setting and comprising an input terminal and an output terminal, a first control signal being generated from the output terminal in accordance with the predetermined setting;

a voltage conversion circuit module, electrically coupled to the output terminal of the control circuit module, to receive the first control signal and convert the first control signal into a second control signal;

a driving module, electrically coupled to the voltage conversion circuit module, to receive the second control signal and generate a driving signal in accordance with the second control signal to drive the lamp; and a feedback circuit, one end thereof electrically coupled to the input terminal of the control circuit module and another end electrically coupled to at least one of the output terminal of the control circuit module, the voltage conversion circuit module and the driving module, for receiving a feedback signal therefrom, and transmitting the feedback signal to the control circuit module, wherein the control circuit module adjusts the first control signal according to the feedback signal being received from the feedback circuit;

wherein a standard driving signal is stored in the control circuit module, and the control circuit module compares a duty cycle of the standard driving signal with that of the feedback signal to determine whether the feedback signal is essentially consistent with the standard driving signal.

8. The driving circuit according to claim 7, wherein the another end of the feedback circuit is electrically coupled to the driving module.

9. The driving circuit according to claim 8, further comprises a reduction voltage conversion circuit module electrically coupled between the driving module and the another end of the feedback circuit to convert a voltage level of the signal outputted from the driving module to a suitable voltage level to be adapted for the control circuit module.

10. The driving circuit according to claim 8, wherein if the feedback signal is considered essentially inconsistent with the standard driving signal, the control circuit module stops outputting the first control signal.

11. A method for driving and preventing a lamp from blasting, comprising steps of:

generating a control signal according to a predetermined setting;

generating a driving signal according to the control signal for driving the lamp;

providing a standard control signal or a standard driving signal;

comparing the control signal with the standard control signal, or comparing the driving signal with the standard driving signal; and stopping driving the lamp if the control signal is essentially inconsistent with the standard control signal, or the driving signal is essentially inconsistent with the standard driving signal;

wherein the step of comparing the control signal with the standard control signal is depending on comparing the duty cycle of the control signal with that of the standard control signal so as to determine whether the control signal is essentially consistent with the standard control signal.

12. The method according to claim 11, wherein if the control signal is essentially inconsistent with the standard control signal, stops outputting the control signal from driving the lamp.

13. A method for driving and preventing a lamp from blasting, comprising steps of:

generating a control signal according to a predetermined setting;

generating a driving signal according to the control signal for driving the lamp;

providing a standard control signal or a standard driving signal;

comparing the control signal with the standard control signal, or comparing the driving signal with the standard driving signal; and stopping driving the lamp if the control signal is essentially inconsistent with the standard control signal, or the driving signal is essentially inconsistent with the standard driving signal;

wherein the step of comparing the driving signal with the standard driving signal is depending on comparing the duty cycle of the driving signal with that of the standard driving signal so as to determine whether the driving signal is essentially consistent with the standard driving signal.

14. The method according to claim 13, wherein if the driving signal is essentially inconsistent with the standard driving signal, stops outputting the control signal from driving the lamp.

* * * * *